US009343825B2

(12) United States Patent
Kashiwada et al.

(10) Patent No.: US 9,343,825 B2
(45) Date of Patent: May 17, 2016

(54) CONNECTOR

(71) Applicant: Sumitomo Wiring Systems, Ltd., Yokkaichi, Mie (JP)

(72) Inventors: Tomokazu Kashiwada, Mie (JP); Masafumi Uno, Mie (JP); Kiyotaka Itsuki, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/666,536

(22) Filed: Mar. 24, 2015

(65) Prior Publication Data

US 2015/0288083 A1 Oct. 8, 2015

(30) Foreign Application Priority Data

Apr. 2, 2014 (JP) ..... 2014-076060

(51) Int. Cl.

| | |
|---|---|
| ***H01R 9/03*** | (2006.01) |
| ***H01R 4/38*** | (2006.01) |
| ***H01R 4/34*** | (2006.01) |
| *H01R 13/631* | (2006.01) |
| *H01R 24/20* | (2011.01) |
| *H01R 103/00* | (2006.01) |

(52) U.S. Cl.

CPC .. *H01R 4/38* (2013.01); *H01R 4/34* (2013.01); *H01R 13/6315* (2013.01); *H01R 24/20* (2013.01); *H01R 2103/00* (2013.01)

(58) Field of Classification Search

CPC ..... H01R 4/38; H01R 24/20; H01R 13/6315; H01R 13/6592; H01R 4/34; H01R 2103/00

USPC ..... 439/247, 607.41–607.45

See application file for complete search history.

(56) References Cited

U.S. PATENT DOCUMENTS

| | | | | |
|---|---|---|---|---|
| 8,172,625 | B2 * | 5/2012 | Kashiwada | H01R 4/184 439/8 |
| 9,022,807 | B2 * | 5/2015 | Uno | H01R 13/6592 439/607.55 |
| 9,124,024 | B2 * | 9/2015 | Itsuki | H01R 13/533 |

FOREIGN PATENT DOCUMENTS

| | | |
|---|---|---|
| JP | 2003-317821 | 11/2003 |

* cited by examiner

*Primary Examiner* — Khiem Nguyen

(74) *Attorney, Agent, or Firm* — Gerald E. Hespos; Michael J. Porco; Matthew T. Hespos

(57) ABSTRACT

A shield connector (10) includes a housing (20) and first and second terminals (50, 60) accommodated in the housing (20). The housing (20) includes first recesses (17) for positioning first connecting portions (51) in a rotation stop state by having first protrusions (52) fitted therein, second recesses (18) for positioning second connecting portions (61) in a rotation stop state by having second protrusions (62) fitted therein and terminal connecting portions (13) to which the first and second connecting portions (51, 62) are to be connected by coaxially arranging first bolt holes (54) and second bolt holes (64) as the first and second connecting portions are positioned.

8 Claims, 7 Drawing Sheets

CONNECTOR

BACKGROUND

1. Field of the Invention

A technology disclosed by this specification relates to a connector.

2. Description of the Related Art

Japanese Unexamined Patent Publication No. 2003-317821 discloses a connector with a housing and an L-shaped busbar. A flat plate-shaped terminal mounted to an end of a wire is connected to one end of the busbar by a bolt and a nut. A device-side flat plate terminal is connected by a bolt and a nut on the other end of the busbar. The position of the busbar can be adjusted within an area of an error absorbing recess of a housing. Thus, a displacement or dimensional inaccuracy of a device-side member and/or the device-side flat plate terminal can be absorbed. However, movement of the busbar relative to the housing can cause the holes of the flat plate terminal and the busbar to be displaced when starting the bolting of the flat plate terminal and the busbar.

Accordingly, an object of the invention is to improve the assembling procedure of a connector.

SUMMARY OF THE INVENTION

The invention relates to a connector with a housing. At least one first terminal and at least one second terminal are accommodated in the housing. The first terminal includes a first connecting portion with a first bolt hole and at least one first protrusion formed on the first connecting portion. The second terminal includes a second connecting portion with a second bolt hole and at least one second protrusion formed on the second connecting portion. The housing includes at least one first recess for positioning the first connecting portion in a rotation stop state by having the first protrusion fit therein and at least one second recess for positioning the second connecting portion in a rotation stop state by having the second protrusion fit therein. The housing also has a terminal connecting portion to which the first and second connecting portions are to be connected by substantially coaxially arranging the first and second bolt holes as the first and second connecting portions are positioned.

Accordingly, the first and second terminals can be positioned with the first and second bolt holes arranged substantially coaxially by fitting the first protrusion into the first recess and fitting the second protrusion into the second recess. Thus, a bolt is inserted more easily into the first and second bolt holes. The first and second connecting portions then can be connected to the terminal connecting portion by bolting.

The first protrusion may have a retaining portion that can be locked to the first recess from an inner side for positioning the first connecting portion in a retained state. Thus, the first protrusion need not be pressed so as not come out of the first recess when fitting the second protrusion into the second recess.

The first connecting portion may be substantially flush with the first protrusion and/or the second connecting portion may be substantially flush with the second protrusion. Accordingly, the first and second protrusions easily are molded simultaneously with the first and second connecting portions.

The first and second connecting portions may be connected in a crossing arrangement. Thus, the first and second protrusions easily are arranged in a displaced manner.

The first and second terminals may be fixed immovably to the terminal connecting portion. Thus, vibration transmitted from the wire to the second terminal can be shut off by the terminal connecting portion and the transmission of vibration to a side further than the first terminal can be prevented.

The second terminal may be connected to an end part of a wire and the housing may include a terminal inserting portion into which the second terminal is to be inserted. A tapered guide may guide the second terminal from a back end portion of the terminal inserting portion toward the terminal connecting portion. Thus, the second connecting portion will not collide with the terminal connecting portion to make the insertion of the second terminal impossible.

The first terminal may be an intermediate terminal to be connected to a connecting terminal that is connectable to a mating connector via a braided wire.

The housing may comprise a floating housing that is mounted therein with a specified clearance so as to be loosely movable in vertical and/or lateral directions within the range of the clearance.

These and other features of the invention will become more apparent upon reading the following detailed description of preferred embodiments and accompanying drawings.

DETAILED DESCRIPTION

Figure 1:
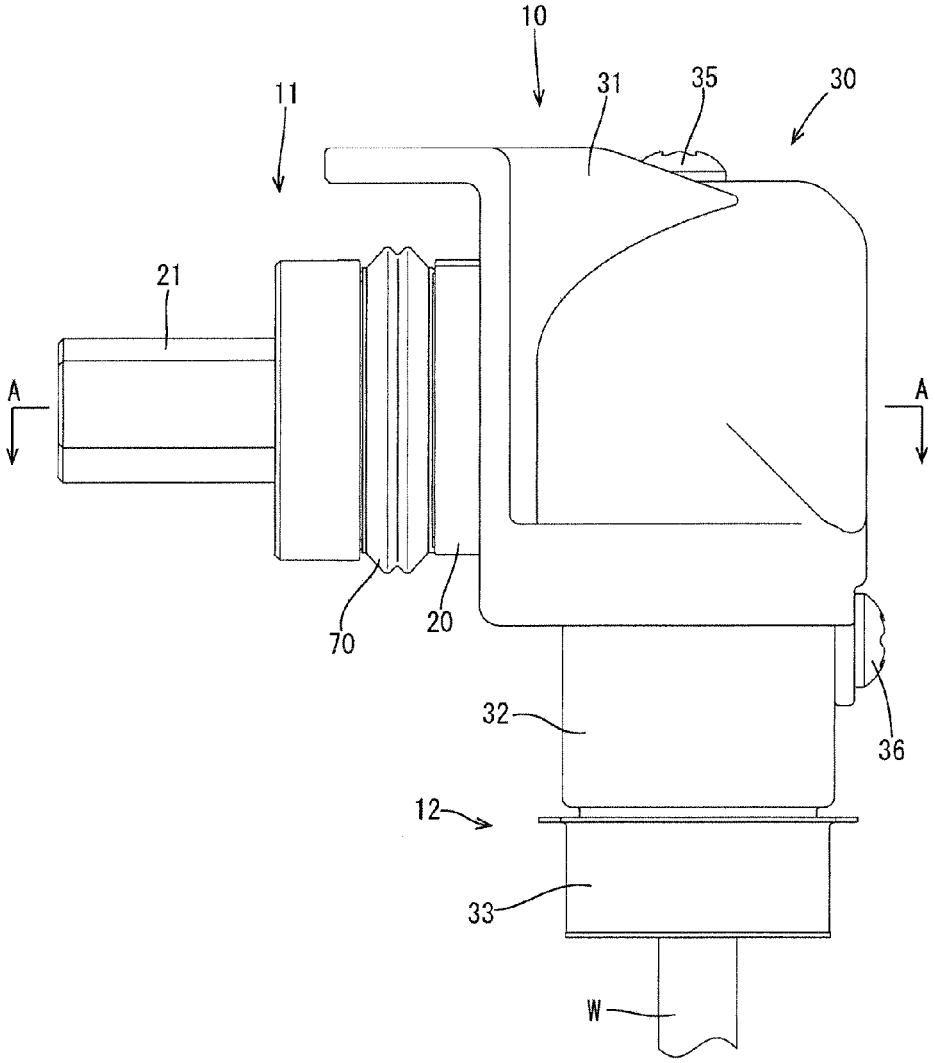
FIG. 1 is a side view of a shield connector.
Figure 2:
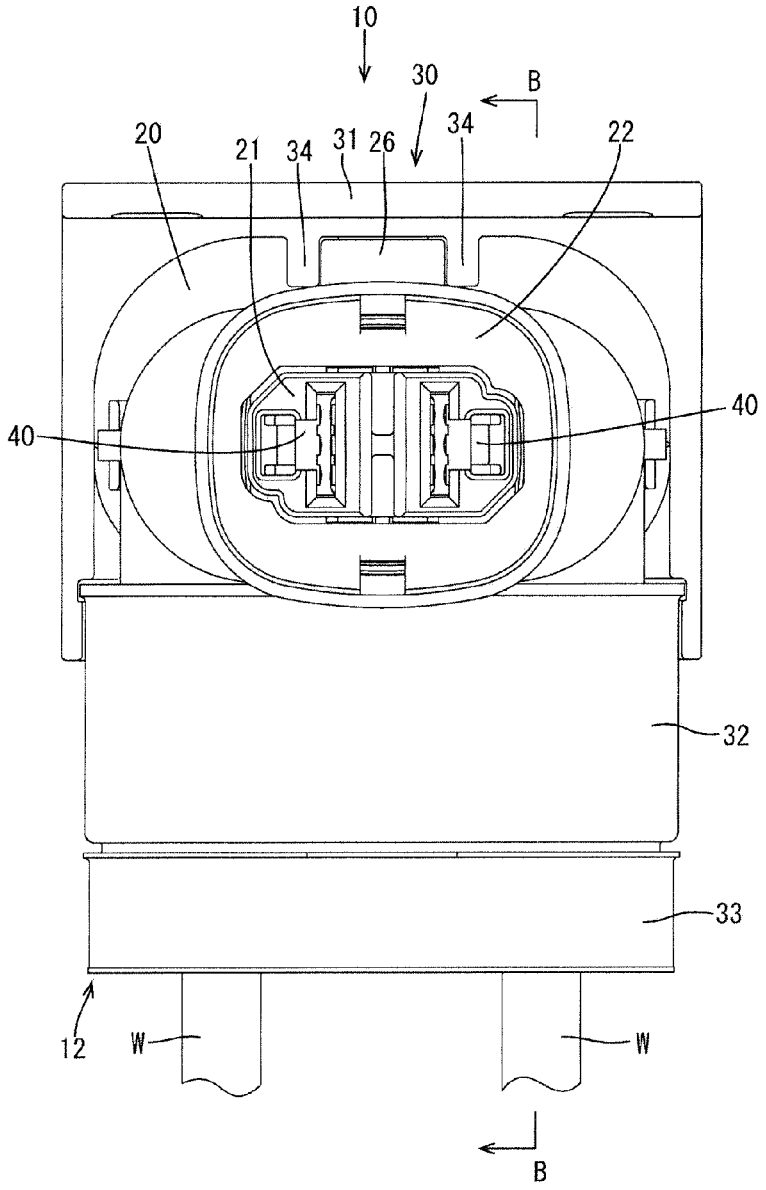
FIG. 2 is a front view of the shield connector.
Figure 3:
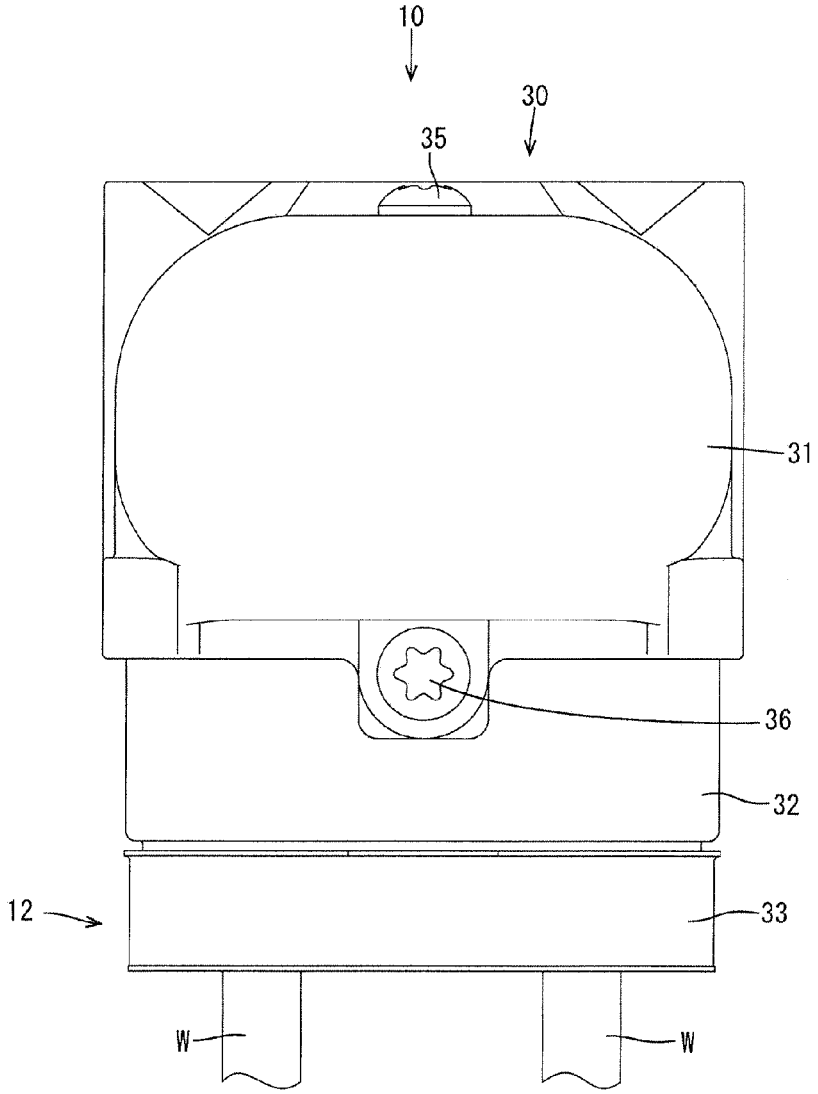
FIG. 3 is a rear view of the shield connector.

An embodiment is described with reference to FIGS. 1 to 7. As shown in FIGS. 1 to 3, a shield connector 10 in this embodiment includes a housing 20 that is L-shaped in a side view, a shield shell 30 surrounding the housing 20 and wires W drawn out from the housing 20. In the following description, a left side in FIG. 1 is referred to as the front, a vertical direction is based on that of FIG. 2 and a width direction is based on a lateral direction of FIG. 2.

Figure 4:
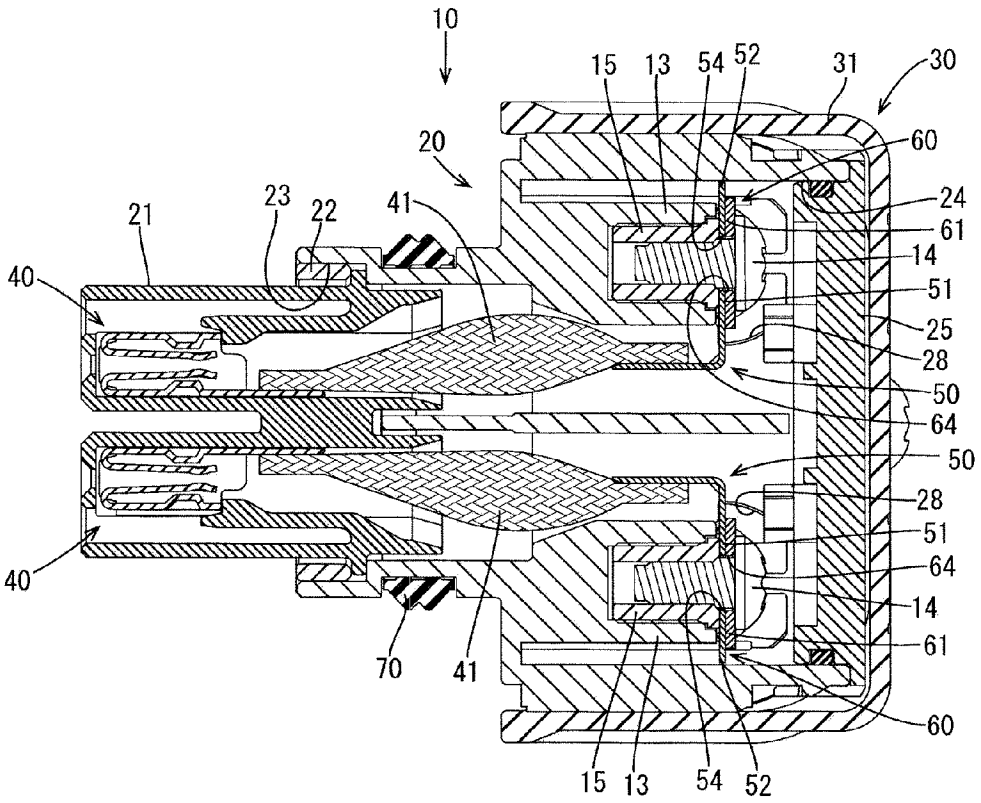
FIG. 4 is a section along A-A of FIG. 1.

A connector fitting portion 11 is formed on a front end side of the shield connector 10 and is fittable into a mounting hole (not shown) formed on a case of a device. A wire draw-out portion 12 is formed on a lower end side of the shield connector 10 and the wires W are drawn out therefrom. A floating housing 21 is assembled with the connector fitting portion 11 and is held by a device-side retainer 22, as shown in FIG. 4, so as not to come out forward. The floating housing 21 is mounted with a predetermined clearance between the floating housing 21 and a front end opening portion 23 of the housing 20 and can move loosely in the vertical and lateral directions within the range of this clearance.

Figure 5:
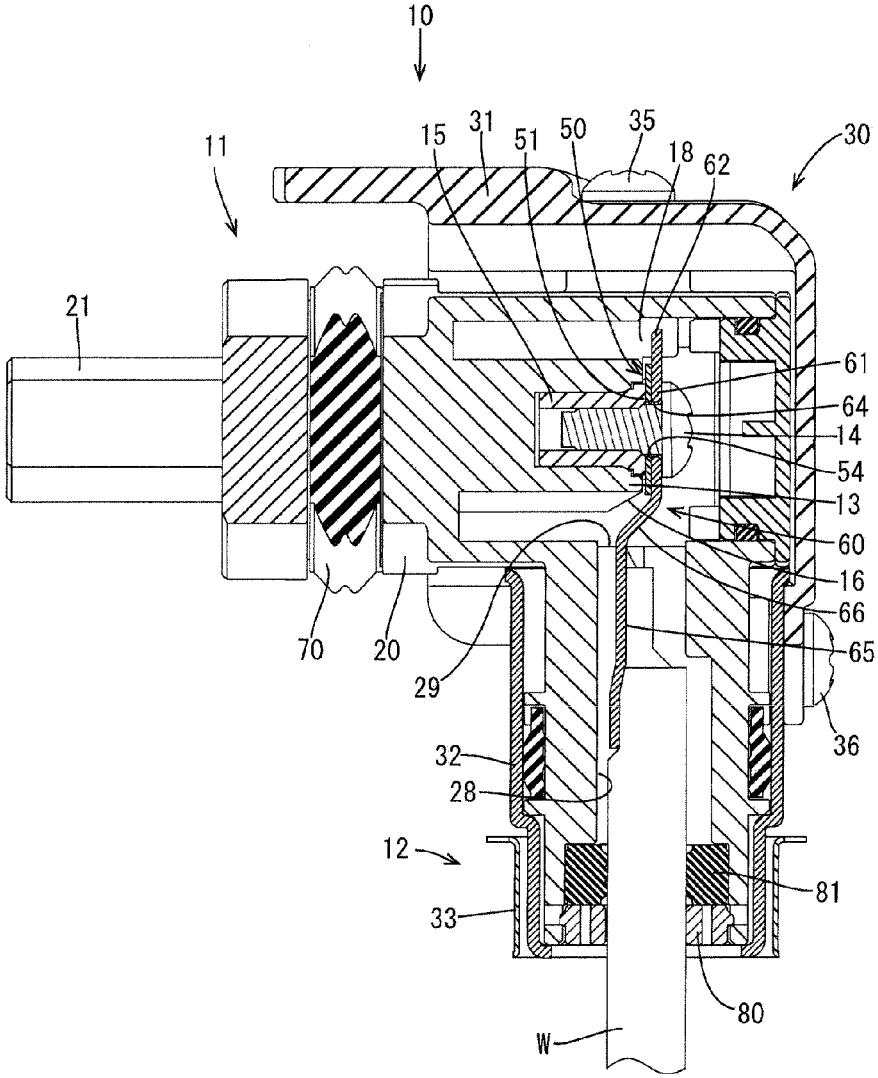
FIG. 5 is a section along B-B of FIG. 2.

Female terminals 40 are held in the floating housing 21. On the other hand, L-shaped intermediate terminals 50, as shown in FIG. 4, and wire-side terminals 60 connected to end parts of the wires W, as shown in FIG. 5, are accommodated in the housing 20. The female terminal 40 and the intermediate terminal 50 are connected by a braided wire 41. The braided wire 41 is formed by braiding metal strands into a tubular shape and bulges out between the female terminal 40 and the intermediate terminal 50.

A cap with a seal 25 is fit in a rear end opening portion 24 of the housing 20. Terminal connecting portions 13 are formed in the housing 20 for electrically conductively connecting the intermediate terminals 50 and the wire-side terminals 60 at positions facing a rear side though the rear end opening portion 24. As shown in FIG. 4, two terminal connecting portions 13 are arranged side by side in the width direction. A cylindrical nut 15 is held in the terminal connecting portion 13 by being press-fit. A seat surface of the nut 15 projects slightly more than a tip surface of the terminal connecting portion 13. The intermediate terminal 50 and the wire-side terminal 60 are placed successively on the seat surface of the nut 15, and the intermediate terminal 50 and the wire-side terminal 60 are fastened together and connected by tightening a bolt 14 into the nut 15.

An operation of tightening the bolt 14 into the nut 15 is performed by inserting a tool through the rear end opening 24 of the housing 20. After fastening, the rear end opening portion 24 is closed in a sealed state by the cap with the seal 25. On the other hand, an annular seal ring 70 is fit on a side of the housing 20 behind the front end opening 23. The seal ring 70 is sandwiched between the inner peripheral surface of a mounting hole of the device and the outer peripheral surface of the housing 20 to seal the interior of the housing 20.

As shown in FIG. 2, the shield shell 30 is composed of an upper shell 31 made of aluminum die cast, a lower shell 32 formed by press-working a metal plate and a caulk ring 33 to be caulked to a lower end part of the lower shell 32. Wires W are drawn out below the lower shell 32, and a braided wire (not shown) for collectively shielding these wires W are crimped to and held on the lower end part of the lower shell 32 by the caulk ring 33.

An upper shell fixing portion 26 is formed on the upper surface of the housing 20, and the upper shell 31 is formed with a pair of guide rails 34 arranged at opposite left and right sides of the upper shell fixing portion 26. A movement of the upper shell 31 to be mounted on the housing 20 from behind can be guided by inserting the upper shell fixing portion 26 between the guide rails 34.

Figure 6:
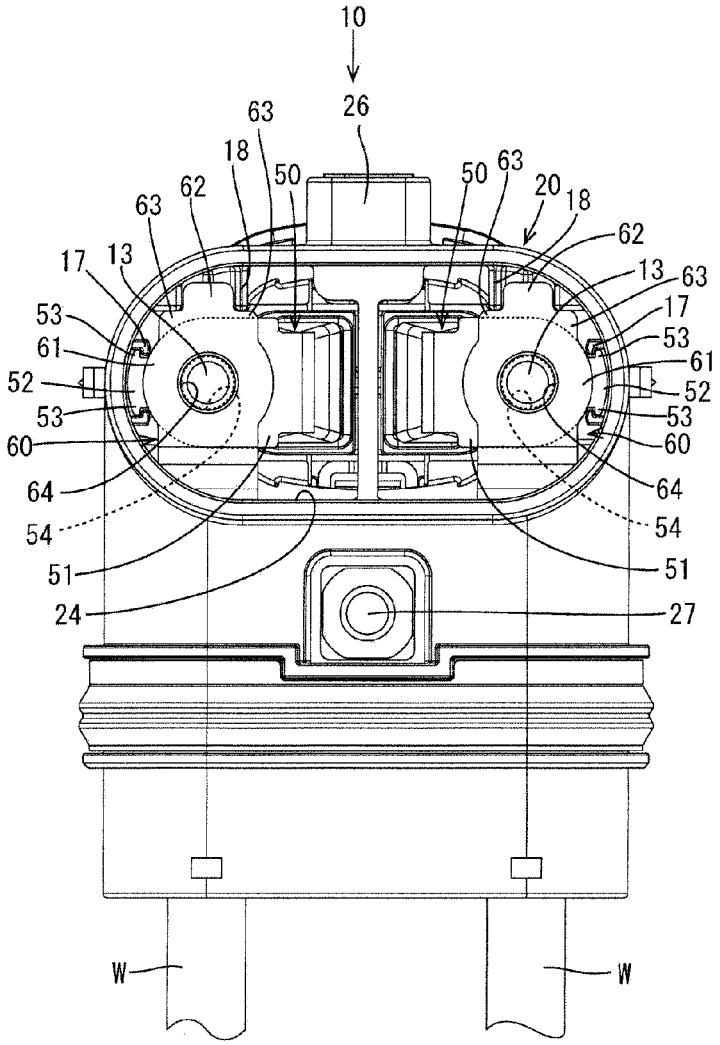
FIG. 6 is a front elevational view with first and second terminals positioned in a rotation stop state with respect to terminal connecting portions.
Figure 7:
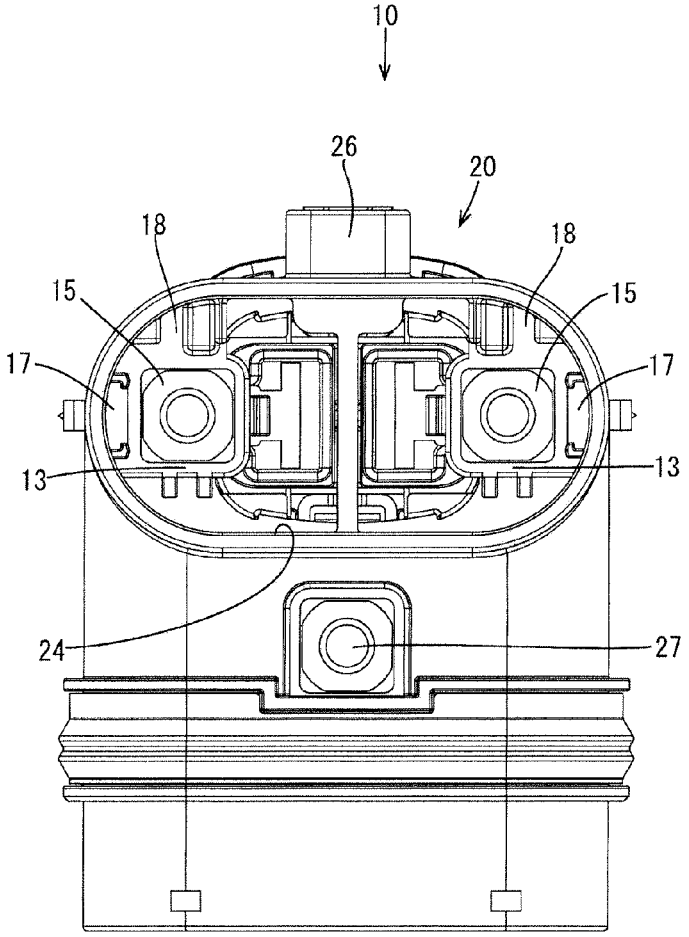
FIG. 7 is a front elevational view showing a state before the first and second terminals are mounted onto the terminal connecting portions.

A lower shell fixing portion 27 is formed on the rear surface of the housing 20, as shown in FIG. 6, and the upper shell 31 and the lower shell 32 are fastened together and fixed to the lower shell fixing portion 27 by a lower bolt 36. On the other hand, the upper shell 31 is fixed singly to the upper shell fixing portion 26 by an upper bolt 35.

As shown in FIG. 6, the intermediate terminal 50 has a first connecting portion 51 in the form of a flat plate with a first bolt hole 54. A substantially arcuate first protrusion 52 is formed on a tip side of a peripheral edge part of the first connecting portion 51. On the other hand, the wire-side terminal 60 has a second connecting portion 61 in the form of a flat plate with a second bolt hole 64. A second protrusion 62 is formed on a tip side of a peripheral edge of the second connecting portion 61 and projects in a step-like manner.

The first protrusion 52 of the intermediate terminal 50 is flush with the first connecting portion 51. The first connecting portion 51 extends out from a central side of the housing 20 in the width direction when the intermediate terminal 50 is accommodated in the housing 20 and the first protrusion 52 on an extending end part of the first connecting portion 51. The first protrusion 52 includes two bulging pieces 53 bulging out toward opposite upper and lower sides along the peripheral edge part of the first connecting portion 51.

On the other hand, a first recess 17 is formed at a widthwise outer side of the terminal connecting portion 13 and the first protrusion 52 of the intermediate terminal 50 is fit therein for positioning the first connecting portion 51 in a rotation stop state. The bulging pieces 53 are locked to peripheral walls located on opposite upper and lower sides of the first recess 17 from an inner side when the first protrusion 52 is fit in the first recess 17. Thus, the first connecting portion 51 is positioned with respect to the terminal connecting portion 13 with the first protrusion 52 retained in the first recess 17.

The second protrusion 62 of the wire-side terminal 60 is flush with the second connecting portion 61. The second connecting portion 61 extends from a lower side toward an upper side of the housing 20 when the wire-side terminal 60 is accommodated in the housing 20 and the second protrusion 62 is located on an extending end part of the second connecting portion 61. Specifically, the first and second connecting portions 51, 61 overlap in a front-back direction while being perpendicular to each other. This overlapping part is formed in a range behind the nut 15 of the terminal connecting portion 13 and faces a tightening seat surface of the nut 13, as shown in FIG. 5. Two contact portions 63 are formed on opposite widthwise sides of a base end of the second protrusion 62.

On the other hand, a second recess 18 for positioning the second connecting portion 61 in a rotation stop state is formed above the terminal connecting portion 13 and the second protrusion 62 of the wire-side terminal 60 can fit therein, as shown in FIG. 6. The contact portions 63 are locked to side walls on opposite left and right sides of the second recess 18 from a lower side when the second protrusion 62 is fit in the second recess 18, thereby further forcibly stopping rotation of the second connecting portion 61.

As shown in FIG. 5, a tapered guide 16 is formed on the lower side of the terminal connecting portion 13. Further, terminal inserting portions 28 are formed in the housing 20 into which the wire-side terminals 60 are to be inserted. The guide 16 has an inclined surface extending obliquely back from a front side of a back end portion 29 of the terminal inserting portion 28 toward the tip surface of the terminal connecting portion 13. This causes the wire-side terminal 60 to be guided to the tip surface of the terminal connecting portion 13 along the guide 16.

A wire connecting portion 65 and the second connecting portion 61 of the wire-side terminal 60 connected to the wire W are coupled by a tapered link 66. This link 66 is arranged along the guide 16. The wire connecting portion 65 is located before the tip surface of the terminal connecting portion 13 and the wire W is connected to the rear surface of the wire connecting portion 65. That is, the wire connecting portion 65 is arranged near the front in an upper end opening of the terminal inserting portion 28. Thus, after being accommodated into the housing 20, the wire-side terminal 60 is inclined obliquely back to ensure a clearance between the second connecting portion 61 and the nut 15 of the terminal connecting portion 13 and the first connecting portion 51 of the intermediate terminal 50 can be inserted into this clearance through the rear end opening 24 of the housing 20.

The shield connector 10 is assembled by initially mounting a wire-side retainer 80 and a rubber plug 81 on each wire W. A core is exposed by stripping the end part of the wire W and is welded or otherwise connected electrically to the wire connecting portion 65 of the wire-side terminal 60. The wire-side terminals 60 then are inserted into the terminal inserting portions 28. The tip of the second connecting portion 61 of the wire-side terminal 60 may contact the guide 16 of the terminal connecting portion 13. However, the inclined surface of the guide 16 guides the tip of the second connecting portion 61 smoothly to the tip surface of the terminal connecting portion 13. Thus, the terminal connecting portion 13 can be inserted behind the nut 15. The rubber plug 81 and the wire-side retainer 80 are inserted in this order into a lower end opening of the terminal inserting portion 28 from below. Thus, the interior of the terminal inserting portion 28 is sealed and the rubber plug 81 presses the wire W over the entire circumference and prevents the wire-side terminals 60 from dropping down from the terminal inserting portion 28.

Subsequently, the female terminals 40 and the intermediate terminals 50 are connected by the braided wires 41. At this time, opposite ends of the braided wire 41 are connected to the respective terminals 40, 50 and the braided wire 41 is caused to bulge out by bringing the respective terminals 40, 50 closer to each other. The female terminal 40 then is inserted into the housing 20 through the rear end opening 24 and enters the interior of the floating housing 21. The first connecting portion 51 of the intermediate terminal 50 is slipped between the nut 15 and the second connecting portion 61, such as by inclining the second connecting portion 61 of the wire-side terminal 60 obliquely back. The first protrusion 52 of the first connecting portion 51 then is fit into the first recess 17. Thereafter, the second protrusion 62 of the second connecting portion 61 of the wire-side terminal 60 is fit into the second recess 18. Then, the first bolt hole 54 of the first connecting portion 51, the second bolt hole 64 of the second connecting portion 61 and a screw hole of the nut 15 are aligned coaxially.

Subsequently, a tool is inserted through the rear end opening 24 of the housing 20 and the bolt 14 is inserted into each bolt hole 54, 64 and tightened into the nut 15. Rotational forces are applied to the respective connecting portions 51, 61 as the bolt 14 is tightened, but the engagement of the respective protrusions 52, 62 in the corresponding recesses 17, 18 prevents rotation. The first and second connecting portions 51, 61 sandwiched directly between the seat surface of the nut 15 and a head of the bolt 14 when the tightening is completed. In this way, the first and second connecting portions 51, 61 are connected electrically conductively and the intermediate terminal 50 and the wire-side terminal 60 are immovably fixed to the terminal connecting portion 13, thereby shutting off vibration from the wire W. The lower and upper shells 32, 31 then are assembled with the housing 20 in this order. The lower bolt 36 is tightened into the lower shell fixing portion 27 and the upper bolt 35 is tightened into the upper shell fixing portion 26. In this way, the assembling of the shield connector 10 is completed.

As described above, the first terminal (intermediate terminal 50) and the second terminal (wire-side terminal 60) can be positioned in a state where the first and second bolt holes 54, 64 are arranged coaxially by fitting the first protrusion 52 into the first recess 17 and fitting the second protrusion 62 into the second recess 18. Thus, the bolt 14 is inserted more easily into the first and second bolt holes 54, 64. Thereafter, the first and second connecting portions 51, 61 can be connected to the terminal connecting portion 13 by bolting.

The first protrusion 52 may have a bulging pieces 53 that locks to the first recess 17 from an inner side and positions the first connecting portion 51 in a retained state. Thus, the first protrusion 52 need not be pressed into the first recess 17 when fitting the second protrusion 62 into the second recess 18.

The first connecting portion 51 may be flush with the first protrusion 52 and the second connecting portion 61 may be flush with the second protrusion 62. Thus, the first and second protrusions 52, 62 are molded more easily simultaneously with the first and second connecting portions 51, 61.

The first and second connecting portions 51, 61 may be connected in an angled in a perpendicular arrangement. Thus, the first and second protrusions 52, 62 are more easily arranged in a displaced manner.

The intermediate terminal 50 and the wire-side terminal 60 may be fixed immovably to the terminal connecting portion 13. Accordingly, vibration transmitted from the wire W to the wire-side terminal 60 can be isolated by the terminal connecting portion 13 and transmission of the vibration to the connector fitting portion 11 located before the intermediate terminal 50 can be prevented.

The wire-side terminal 60 may be connected to the end part of the wire W and the housing 20 may include the terminal inserting portion 28, into which the wire-side terminal 60 is to be inserted, and the tapered guide portion 16 for guiding the wire-side terminal 60 toward the terminal connecting portion 13 from the back end portion 29 of the terminal inserting portion 28. Accordingly, the second connecting portion 61 is guided to the terminal connecting portion 13 by the tapered guide 16 in inserting the wire-side terminal 60 into the terminal inserting portion 28. Thus, the second connecting portion 61 will not collide with the terminal connecting portion 13 to permit insertion of the wire-side terminal 60.

The invention is not limited to the above described embodiment. For example, the following various modes are also included.

The first protrusion 52 is formed on the tip side of the first connecting portion 51 and the second protrusion 62 is formed on or near the tip side of the second connecting portion 61 in the above embodiment, another mode may be adopted if the first and second protrusions do not overlap.

The female terminal 40 and the intermediate terminal 50 are connected by the braided wire 41, but a terminal integrally or unitarily formed with the female terminal 40 and the intermediate terminal 50 may be the first terminal.

The first connecting portion 51 is retained in the terminal connecting portion 13 by locking the bulging pieces 53 of the first protrusion 52 to the first recess 17 from the inner side in the above embodiment, it may be not be retained similarly to the second protrusion 62.

The protrusions 52, 62 are substantially flush with the connecting portions 51, 61 in the above embodiment, but each protrusion may be formed by cutting a piece in the corresponding connecting portion and bending the cut piece.

The connecting portions 51, 61 are perpendicular in the above embodiment, but the intermediate terminal may extend down from a side above the terminal connecting portion 13 and the respective connecting portions may face in directions opposite to each other.

The respective terminals 50, 60 are fixed to the terminal connecting portion 13 in the above embodiment, but they may be loosely movable on the terminal connecting portion, for example, by movably accommodating the nut 15 in the terminal connecting portion.

A tapered guide 16 is provided on the terminal connecting portion 13 in the above embodiment. However, a tapered guide may be provided on the tip of the second connecting portion 61 of the wire-side terminal 60.

Although the first and second connecting portions 51, 61 are perpendicular in the above embodiment, they may cross at a different angle.

REFERENCE SIGNS

10 . . . shield connector
13 . . . terminal connecting portion
16 . . . guide portion
17 . . . first recess
18 . . . second recess
20 . . . housing
28 . . . terminal inserting portion
29 . . . back end portion
40 . . . female terminal (connecting terminal)

41 . . . braided wire
50 . . . intermediate terminal (first terminal)
51 . . . first connecting portion
52 . . . first protrusion
53 . . . bulging piece (retaining portion)
54 . . . first bolt hole
60 . . . wire-side terminal (second terminal)
61 . . . second connecting portion
62 . . . second protrusion
64 . . . second bolt hole
W . . . wire

What is claimed is:

1. A connector, comprising a housing and at least one first terminal and at least one second terminal at least partly accommodated in the housing, wherein:

the first terminal includes a first connecting portion with a first bolt hole and at least one first protrusion formed on the first connecting portion;

the second terminal includes a second connecting portion with a second bolt hole and at least one second protrusion formed on the second connecting portion; and the housing includes at least one first recess for positioning the first connecting portion in a rotation stop state by having the first protrusion at least partly fitted therein, at least one second recess for positioning the second connecting portion in a rotation stop state by having the second protrusion at least partly fitted therein and a terminal connecting portion to which the first and second connecting portions are to be connected by substantially coaxially arranging the first and second bolt holes as the first and second connecting portions are positioned.

2. A connector of claim 1, wherein the first protrusion includes at least one retaining portion for positioning the first connecting portion in a retained state by being locked to the first recess from an inner side.

3. The connector of claim 1, wherein the first connecting portion is substantially flush with the first protrusion and the second connecting portion is substantially flush with the second protrusion.

4. The connector of claim 1, wherein the first and second connecting portions are connected in a crossing arrangement.

5. The connector of claim 1, wherein the first and second terminals are fixed immovably to the terminal connecting portion.

6. The connector of claim 1, wherein the second terminal is to be connected to a wire and the housing includes a terminal inserting portion, into which the second terminal is to be inserted, and a guide for guiding the second terminal from a back end portion of the terminal inserting portion toward the terminal connecting portion.

7. The connector of claim 1, wherein the first terminal is an intermediate terminal to be connected to a connecting terminal connectable to a mating connector via a braided wire.

8. The connector of claim 1, wherein the housing comprises a floating housing which is mounted therein with a specified clearance so as to be loosely movable in vertical and lateral directions within a range of the clearance.

* * * * *